US007918098B2

(12) United States Patent
Ko et al.

(10) Patent No.: US 7,918,098 B2
(45) Date of Patent: Apr. 5, 2011

(54) AIR CONDITIONING SYSTEM

(75) Inventors: Young Hwan Ko, Changwon-si (KR); Bum Suk Kim, Changwon-si (KR); Man Ho Chun, Changwon-si (KR)

(73) Assignee: LG Electronics Inc., Seoul (KR)

( * ) Notice: Subject to any disclaimer, the term of this patent is extended or adjusted under 35 U.S.C. 154(b) by 323 days.

(21) Appl. No.: 12/213,486

(22) Filed: Jun. 19, 2008

(65) Prior Publication Data

US 2009/0188265 A1 Jul. 30, 2009

(30) Foreign Application Priority Data

Jan. 28, 2008 (KR) ..... 10-2008-0008659

(51) Int. Cl.
*F25B 41/04* (2006.01)
*F25D 23/12* (2006.01)

(52) U.S. Cl. ..... 62/222; 62/259.1

(58) Field of Classification Search ..... 62/222, 62/259.1, 228.5, 196.1, 498, 208, 510, 513; 700/275; 165/166
See application file for complete search history.

(56) References Cited

U.S. PATENT DOCUMENTS

| | | | | |
|---|---|---|---|---|
| 4,359,877 | A * | 11/1982 | Coyne | 62/278 |
| 5,056,329 | A | 10/1991 | Wilkinson | |
| 5,752,391 | A * | 5/1998 | Ozaki et al. | 62/228.1 |
| 2005/0217292 | A1 | 10/2005 | Onishi et al. | |
| 2006/0042282 | A1 | 3/2006 | Ludwig et al. | |
| 2009/0165481 | A1 * | 7/2009 | Ko et al. | 62/195 |

FOREIGN PATENT DOCUMENTS

| | | | |
|---|---|---|---|
| CN | 1376251 | | 10/2002 |
| JP | 2006258343 | A * | 9/2006 |
| JP | 2007-263383 | | 10/2007 |

* cited by examiner

*Primary Examiner* — Chen-Wen Jiang
(74) *Attorney, Agent, or Firm* — McKenna Long & Aldridge LLP

(57) ABSTRACT

An air conditioning system can improve the cooling/heating performance of the system because the injection of refrigerant into the compressor is achieved. The air conditioning system can further improve the cooling/heating performance in a low temperature region by injecting refrigerant as a two-phase refrigerant or a superheated vapor state into the compressor. The air conditioning system can prevent damage of the compressor and further improve reliability by controlling such that the ratio of a liquid refrigerant in the refrigerant injected into the compressor may be less than a set value.

15 Claims, 7 Drawing Sheets

AIR CONDITIONING SYSTEM

This nonprovisional application claims priority under 35 U.S.C. §119(a) on Patent Application No. 10-2008-0008659 filed in Republic of Korea on Jan. 28, 2008, the entire contents of which are hereby incorporated by reference.

BACKGROUND OF THE INVENTION

1. Field of the Invention

The present invention relates to an air conditioning system, and more particularly, to an air conditioning system, which can improve the performance and stability of the system by controlling such that the ratio of a liquid refrigerant in the refrigerant injected into a compressor may be less than a predetermined value.

2. Discussion of the Related Art

Generally, an air conditioning system is an apparatus which cools or heats indoor spaces by compressing, condensing, expanding, and evaporating a refrigerant.

The air conditioning systems are classified into a normal air conditioner including an outdoor unit and an indoor unit connected to the outdoor unit and a multi-type air conditioner including an outdoor unit and a plurality of indoor units connected to the outdoor unit. Moreover, the air conditioning systems are classified into a cooling air conditioner supplying a cool air only to an indoor space by driving a refrigerant cycle in one direction only and a cooling and heating air conditioner supplying a cool or hot air to an indoor space by driving a refrigerant cycle selectively and bi-directionally.

The air conditioning system includes a compressor, a condenser, an expansion valve, and an evaporator. The refrigerant discharged from the compressor is condensed in the condenser, and then expands in the expansion valve. The expanded refrigerant is evaporated in the evaporator, and then sucked into the compressor. IN a cooling operation or heating operation, a gaseous refrigerant is injected into the compressor, thus improving performance.

However, in a case where excessive liquid refrigerant exists in a refrigerant being injected, liquid compression may occur and this may lead to damage to the compressor.

SUMMARY OF THE INVENTION

It is an object of the present invention to provide an air conditioning system, which can improve the performance and stability of the system.

The present invention provides an air conditioning system, comprising: a compressor for compressing refrigerant; a condenser for condensing the refrigerant discharged from the compressor; a first expansion device for throttling the refrigerant passed through the condenser; a second expansion device for throttling the refrigerant passed through the first expansion device; an injection valve for throttling the refrigerant bypassed between the first expansion device and the second expansion device and injecting into the compressor; and a control unit for controlling such that the ratio of a liquid refrigerant in the refrigerant injected into the compressor may be less than a predetermined value.

In the present invention, the air conditioning system further comprise heating means for heating the refrigerant passed through the injection valve when the air conditioning system is in a heating operation.

In the present invention, the control unit controls the heating means so that the ratio of a liquid refrigerant in the refrigerant injected into the compressor may be less than a predetermined value. The control unit controls the opening degree of the injection valve so that the ratio of a liquid refrigerant in the refrigerant injected into the compressor may be less than a predetermined value. The control unit detects a value of at least one of operating parameters, and adjusts the opening degree of the injection valve based on detected value of the operating parameter. The operating parameters include the suction temperature of the refrigerant sucked into the compressor and the discharge temperature of the refrigerant discharged from the compressor.

In the present invention, the heating means comprises an injection heat exchanger for performing heat exchange between the refrigerant passed through the injection valve and the refrigerant introduced into the second expansion device. The injection heat exchanger may comprise a first refrigerant pipe for passing either the refrigerant passed through the injection valve or the refrigerant introduced into the second expansion device through and a second refrigerant pipe formed so as to cover the first refrigerant pipe and for passing the other refrigerant through. The injection heat exchanger may be formed in a loop shape. The injection heat exchanger may include a plate type heat exchanger. The injection heat exchanger may be installed at a base pan of an outdoor unit included in the air conditioning system, and disposed in parallel to the base pan.

In the present invention, when the air conditioning system is in a cooling operation, the injection heat exchanger supercools the refrigerant coming from the condenser.

In the present invention, the air conditioning system further comprises a phase separator for storing the refrigerant passed through the first expansion device and separating the phase of the stored refrigerant. Only a liquid refrigerant may be discharged from the phase separator.

In the present invention, the air conditioning system further comprises an evaporator for evaporating the refrigerant passed through the second expansion device, and the compressor comprises a first compressing part for compressing the refrigerant passed through the evaporator and a second compressing part for compressing both the refrigerant passed through the first compressing part and the refrigerant injected after bypassed between the first expansion device and the second expansion device.

In the present invention, the control unit controls the first expansion device in a first control method, and controls the second expansion device in a second control method, different from the first control method. In the first control method, a value of at least one of operating parameters is detected, and a target opening degree of the first expansion device is determined based on a stored set value corresponding to the detected value of the operating parameter. In the second control method, the degree of superheat of refrigerant is measured in real time, and the opening amount of the second expansion device is changed based on the measured degree of superheat until the measured degree of superheat reaches a preset degree of superheat.

Furthermore, the present invention provides an air conditioning system, comprising: a compressor for compressing refrigerant; a condenser for condensing the refrigerant discharged from the compressor; a first expansion device for throttling the refrigerant passed through the condenser; a second expansion device for throttling the refrigerant passed through the first expansion device; an injection valve for throttling the refrigerant bypassed between the first expansion device and the second expansion device and injecting into the compressor; an injection heat exchanger for performing heat exchange between the refrigerant passed through the injection valve and the refrigerant introduced into the second expansion device; and a control unit for controlling the opening degree of the injection valve so that the ratio of a liquid refrigerant in the refrigerant injected into the compressor may be less than a predetermined value.

Furthermore, the present invention provides an air conditioning system, comprising: a compressor for compressing refrigerant; a condenser for condensing the refrigerant discharged from the compressor; a first expansion device for throttling the refrigerant passed through the condenser; a phase separator for storing the refrigerant coming from the first expansion device and separating the phase of the stored refrigerant; a second expansion device for throttling the refrigerant coming from the phase separator; an injection valve for throttling the refrigerant bypassed between the phase separator and the second expansion device and injecting into the compressor; an injection heat exchanger for performing heat exchange between the refrigerant passed through the injection valve and the refrigerant introduced into the second expansion device; and a control unit for controlling such that the ratio of a liquid refrigerant in the refrigerant injected into the compressor may be less than a predetermined value.

The air conditioning system according to the present invention can improve the cooling/heating performance of the system because the injection of refrigerant into the compressor is achieved.

Furthermore, the air conditioning system according to the present invention can further improve the cooling/heating performance in a low temperature region by injecting the refrigerant as a two-phase refrigerant or a superheated vapor state into the compressor.

Furthermore, the air conditioning system according to the present invention can prevent damage of the compressor and further improve reliability by controlling such that the ratio of a liquid refrigerant in the refrigerant injected into the compressor may be less than a set value.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

An air conditioning system includes general residential cooling air conditioner for performing a cooling operation only, a heating air conditioner for performing a heating operation only, a heat pump type air conditioner for performing both cooling and heating operations, and a multi-type air conditioner for cooling and heating a plurality of indoor spaces. Hereinafter, as one example of the air conditioning system, a heat pump type air conditioner (hereinafter, referred to as "air conditioner") will be described in details.

Figure 1:
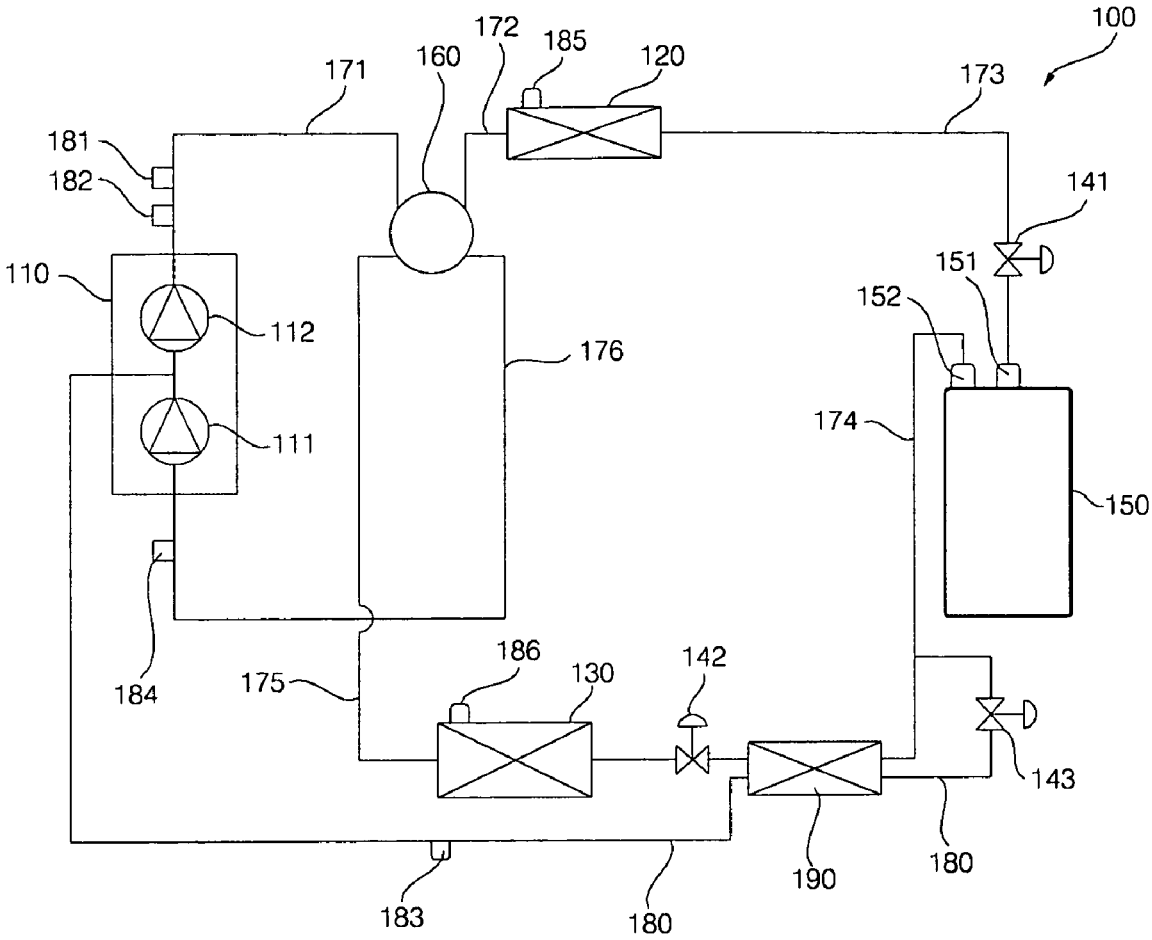
FIG. 1 is a view showing the construction of an air conditioner in accordance with an embodiment of the present invention.
Figure 2:
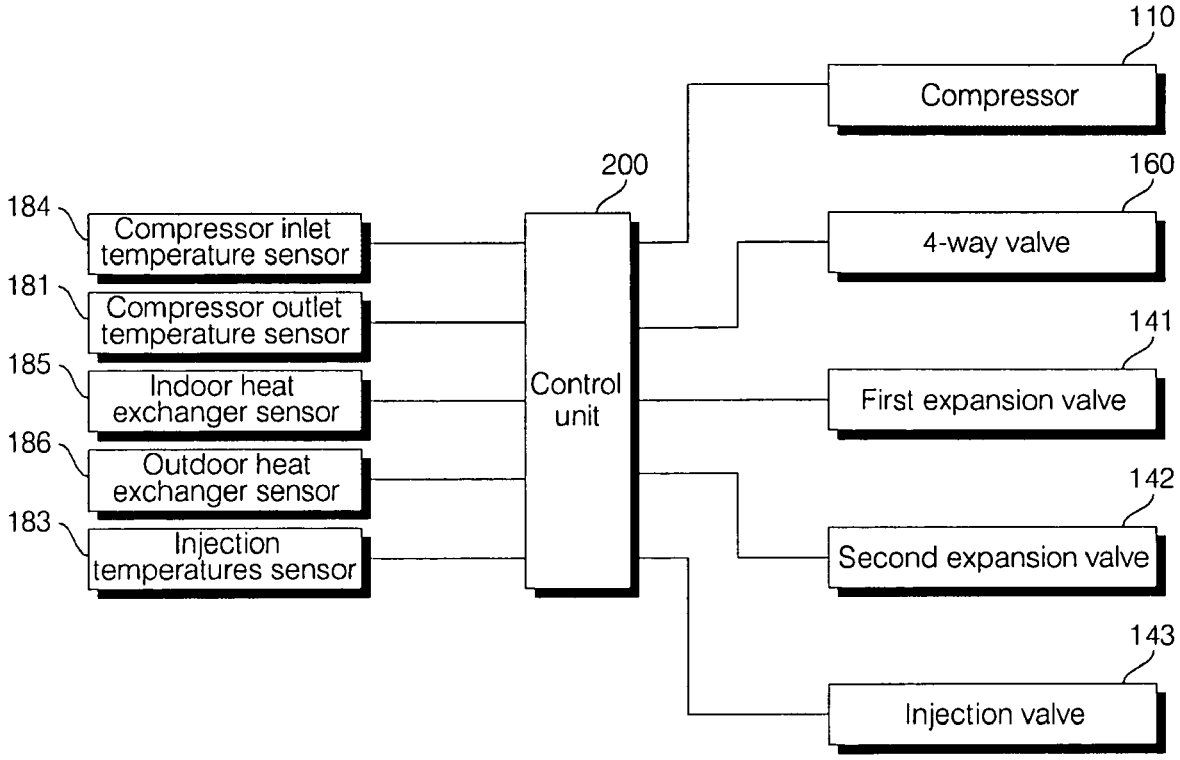
FIG. 2 is a block diagram showing a control flow of the air conditioner.

FIG. 1 is a view showing the construction of an air conditioner 100 in accordance with an embodiment of the present invention. FIG. 2 is a block diagram showing a control flow of the air conditioner 100.

Referring to FIGS. 1 and 2, the air conditioner 100 includes a compressor 110, an indoor heat exchanger 120, an outdoor heat exchanger 130, a first expansion valve 141, a second expansion valve 142, a phase separator 150, and a 4-way valve 160. The indoor heat exchanger 120 functions as an evaporator in a cooling operation and functions as a condenser in a heating operation. The compressor 110 compresses an introduced refrigerant of low temperature and low pressure into a refrigerant of high temperature and high pressure. The compressor 110 includes a first compressing part 111 and a second compressing part 112. The first compressing part 111 compresses the refrigerant introduced from the evaporator, and the second compressing part 112 mixes and compresses the refrigerant coming from the first compressing part 111 and the refrigerant injected by being branched between the evaporator and the condenser. However, the present invention is not limited thereto, and the compressor 110 can have a multi-layered structure more than three layers. As the compressor 110, a scroll compressor or a rotary compressor may be used.

The 4-way valve 160 is a flow path switching valve for switching the flow of refrigerant upon cooling and heating, and guides the refrigerant compressed in the compressor 110 to the outdoor heat exchanger 130 upon cooling and guides the same to the indoor heat exchanger 120 upon heating. The 4-way valve 160 and the compressor 110 are connected via a first connecting pipe 171. A compressor outlet temperature sensor 181 and a discharge pressure sensor 182 are disposed on the first connecting pipe 171 in order to measure the discharge temperature and pressure of the refrigerant discharged from the compressor 110. The indoor heat exchanger 120 is disposed in a room, and is connected to the 4-way vale 160 via a second connecting pipe 172.

The phase separator 150 temporally stores an introduced refrigerant, separates it into a gaseous refrigerant and a liquid refrigerant, and sends only the liquid refrigerant, among the stored refrigerants. A first connecting part 151 of the phase separator 150 and the indoor heat exchanger 120 are connected via a third connecting pipe 173. The outdoor heat exchanger 130 is disposed outdoors, and is connected to a second connecting part 152 of the phase separator 150 via a fourth connecting pipe 174.

The first expansion valve 141 is disposed on the third connecting pipe 173, and serves as a second expansion device for throttling the liquid refrigerant introduced from the phase separator 150 in a cooling operation and serves as a first expansion device for throttling the liquid refrigerant introduced from the indoor heat exchanger 120 serving as a condenser in a heating operation.

An outdoor heat exchanger sensor 186 is installed at the outdoor heat exchanger 130. The second connecting pipe 152 serves as a refrigerant inlet pipe in a cooling operation and serves as a liquid refrigerant discharge pipe in a heating operation.

The second expansion valve 142 is disposed on the fourth connecting pipe 174, and serves as a first expansion device for throttling the liquid refrigerant introduced from the outdoor heat exchanger 130 serving as a condenser in a cooling operation and serves as a second expansion device for throttling the liquid refrigerant introduced from the phase separator 150 in a heating operation.

The 4-way valve 160 is connected to the outdoor heat exchanger 130 via a fifth connecting pipe 175. Also, the 4-way valve 160 and an inlet pipe of the compressor 110 are connected via a sixth connecting pipe 176.

A compressor inlet temperature sensor 184 for measuring the temperature of the inlet side of the compressor 110 is disposed on the sixth connecting pipe 176.

The air conditioning system further includes an injection pipe 180 bypassed from the fourth connecting pipe 174 and connected to the second compressing part 112.

An injection valve 143 is disposed on the injection pipe 180. The injection valve 143 controls the amount and pressure of the refrigerant injected into the second compressing part 112.

The air conditioning system further includes heating means for heating the refrigerant passed through the injection valve 143 when the air conditioning system is in a heating operation. The heating means heats the refrigerant so that the ratio of a liquid refrigerant injected into the compressor to the liquid refrigerant coming from the phase separator may be less than a predetermined value. The heating means is disposed so as to connect the fourth connecting pipe 174 and the injection pipe 180. The heating means is an injection heat exchanger 190 which is formed so as to perform heat exchange between the refrigerant throttled in the injection valve 143 and the refrigerant introduced into the second expansion valve 142.

Figure 3:
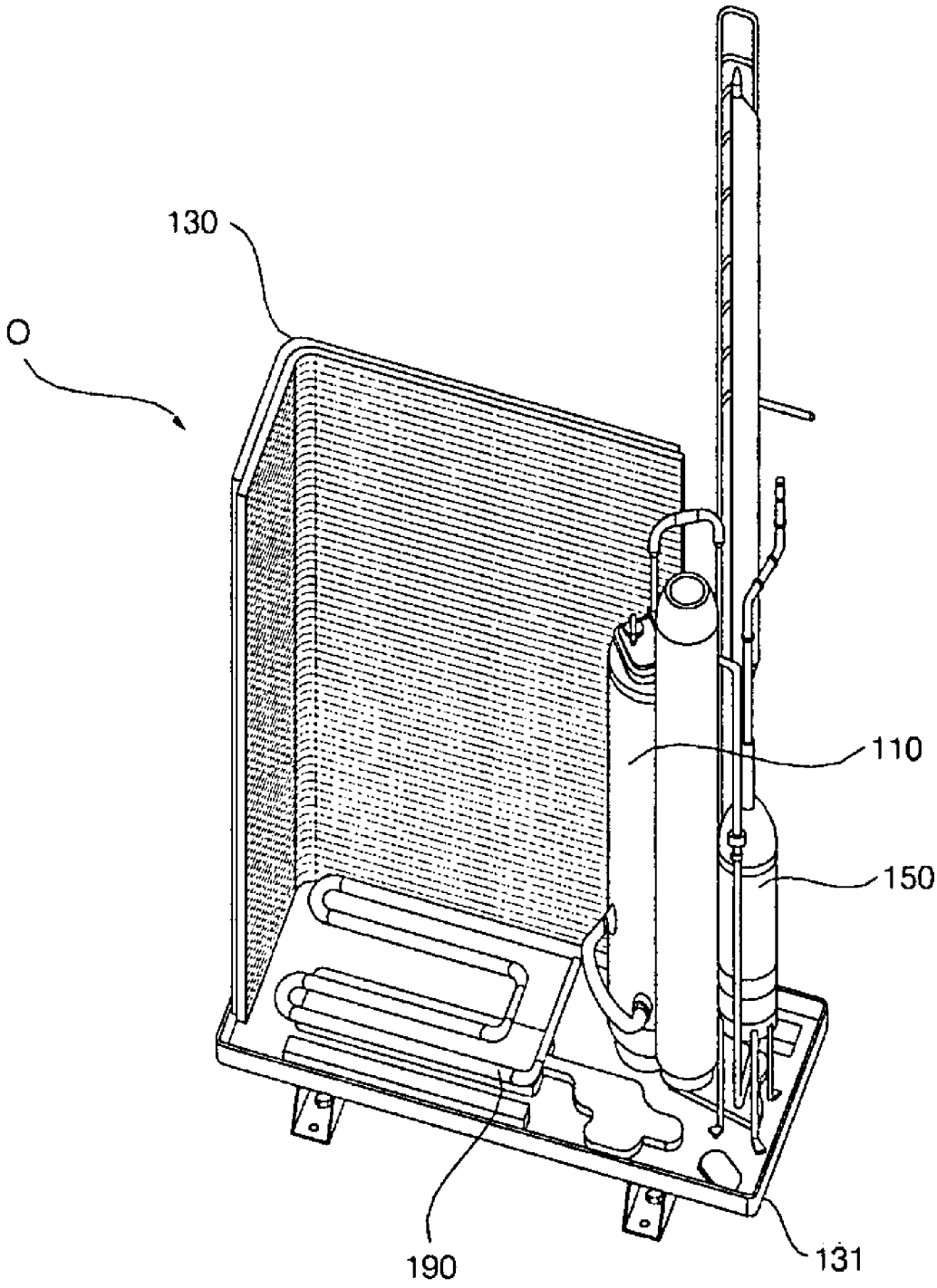
FIG. 3 is a perspective view illustrating an installation structure of an outdoor heat exchanger and an injection heat exchanger as shown in FIG. 1.

FIG. 3 is a perspective view illustrating an installation structure of an outdoor heat exchanger 130 and an injection heat exchanger 190 as shown in FIG. 1.

Referring to FIG. 3, the injection heat exchanger 190 and the outdoor heat exchanger are installed at a base pan 131 of an outdoor unit 0. The outdoor heat exchanger 130 is disposed perpendicular to the base pan 131, and the injection heat exchanger 190 is disposed in parallel to the base pan 131. That is to say, the injection heat exchanger 190 is spaced apart from the outdoor heat exchanger 130 and installed in a different disposition direction so as to minimize the effect of the air passing through the heat exchanger 130.

Figure 4:
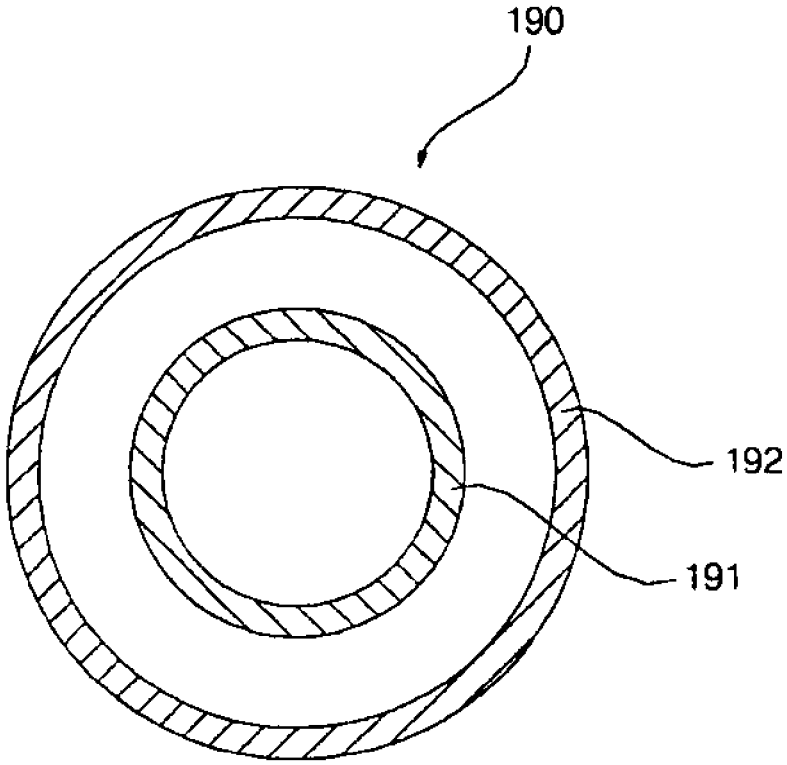
FIG. 4 is a cross sectional view of the injection heat exchanger 190 as shown in FIG. 3.

FIG. 4 is a cross sectional view of the injection heat exchanger 190 as shown in FIG. 3.

Referring to FIG. 4, the injection heat exchanger 190 includes a first refrigerant pipe 191 for passing a refrigerant introduced into the second expansion device through and a second refrigerant pipe 192 formed so as to cover the first refrigerant pipe 191 and for passing a refrigerant throttled in the injection valve 143. That is to say, the injection heat exchanger 190 is formed in a dual pipe of the first refrigerant pipe 191 and the second refrigerant pipe 192. The first and second refrigerant pipes 191 and 192 may be made of aluminum material.

Referring to FIG. 3, the injection heat exchanger 190 is formed in a loop shape by being bent multiple times, has a small pressure loss, can obtain a length at which heat exchange is possible, and is easily installed even in a narrow space. However, the present invention is not limited thereto, and the injection heat exchanger 190 may also be formed in a plate type heat exchanger.

An injection temperature sensor 183 for measuring the temperature of the refrigerant being injected is disposed on the injection pipe 180.

Opening amounts of the first and second expansion valves 141 and 142 and the injection valve 143 are controlled by a control unit 200 for controlling the operation of the air conditioner.

Figure 5:
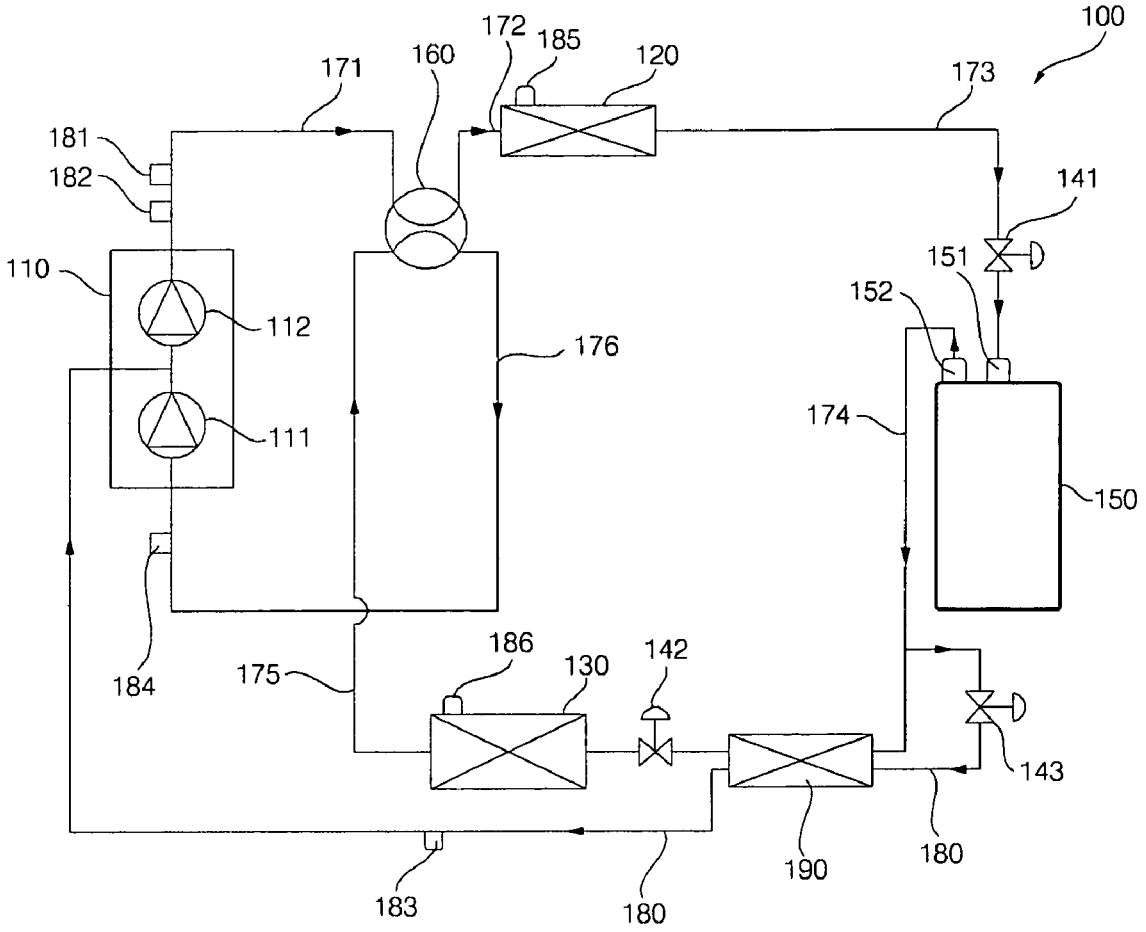
FIG. 5 illustrates the flow of refrigerant in a heating operation of the air conditioner as shown in FIG. 1.

FIG. 5 illustrates the flow of refrigerant in a heating operation of the air conditioner.

Referring to FIG. 5, a gaseous refrigerant of high temperature and high pressure discharged from the compressor 110 is introduced into the indoor heat exchanger 120 via the 4-way valve 160. In the indoor heat exchanger 120, the gaseous refrigerant is condensed by heat exchange with indoor air. The condensed refrigerant is throttled in the first expansion valve 141, and then introduced into the phase separator 150. A liquid refrigerant coming from the phase separator 150 passes through the fourth connecting pipe 174.

If there is a request for performing gas injection during the heating operation, the control unit 200 opens the injection valve 143. As the injection valve 143 is opened, some of the refrigerant passing through the fourth connecting pipe 174 is bypassed to the injection pipe 180 and throttled in the injection valve 143. Because the refrigerant throttled in the injection valve 143 drops in temperature and pressure, it is subjected to a relatively lower temperature than the refrigerant introduced into the injection heat exchanger 190 through the fourth connecting pipe 174. Therefore, heat exchange between the refrigerant passed through the injection valve 143 and the refrigerant introduced into the second expansion valve 142 through the fourth connecting pipe 174 takes place in the injection heat exchanger 190. In the injection heat exchanger 190, the refrigerant introduced into the second expansion valve 142 is deprived of heat, while the refrigerant passed through the injection valve 143 absorbs heat. The refrigerant deprived of heat in the injection heat exchanger 190 is throttled in the second expansion valve 142, and then introduced into the outdoor heat exchanger 130. The refrigerant introduced into the outdoor heat exchanger 130 is evaporated by heat exchange with outside air, and the evaporated refrigerant is introduced into the first compressing part 111.

At least some of the refrigerant having absorbed heat in the injection heat exchanger 190 is evaporated, and is subjected to a refrigerant of two phases, that is, gaseous and liquid phases in a mixed state, or a refrigerant in a superheated vapor state. The ratio of a liquid refrigerant in the refrigerant having absorbed heat in the injection heat exchanger 190 can be adjusted according to the opening degree of the injection heat exchanger 190 or the injection valve 143, and will be explained in detail in a control method to be described later.

Accordingly, the refrigerant of two phases or the refrigerant in a superheated vapor state is injected into the second compressing part 112 through the injection pipe 180. Since the refrigerant of two phases or the refrigerant in a superheated vapor state is injected into the second compressing part 112 through the injection pipe 180, cooling/heating performance can be improved compared to the injection of only a gaseous refrigerant. In the second compressing part 112, the injected refrigerant and the refrigerant coming from the first compressing part 111 are mixed, and then compressed. The refrigerant compressed in the second compressing part 112 is circulated again through the 4-way valve 160.

Figure 6:
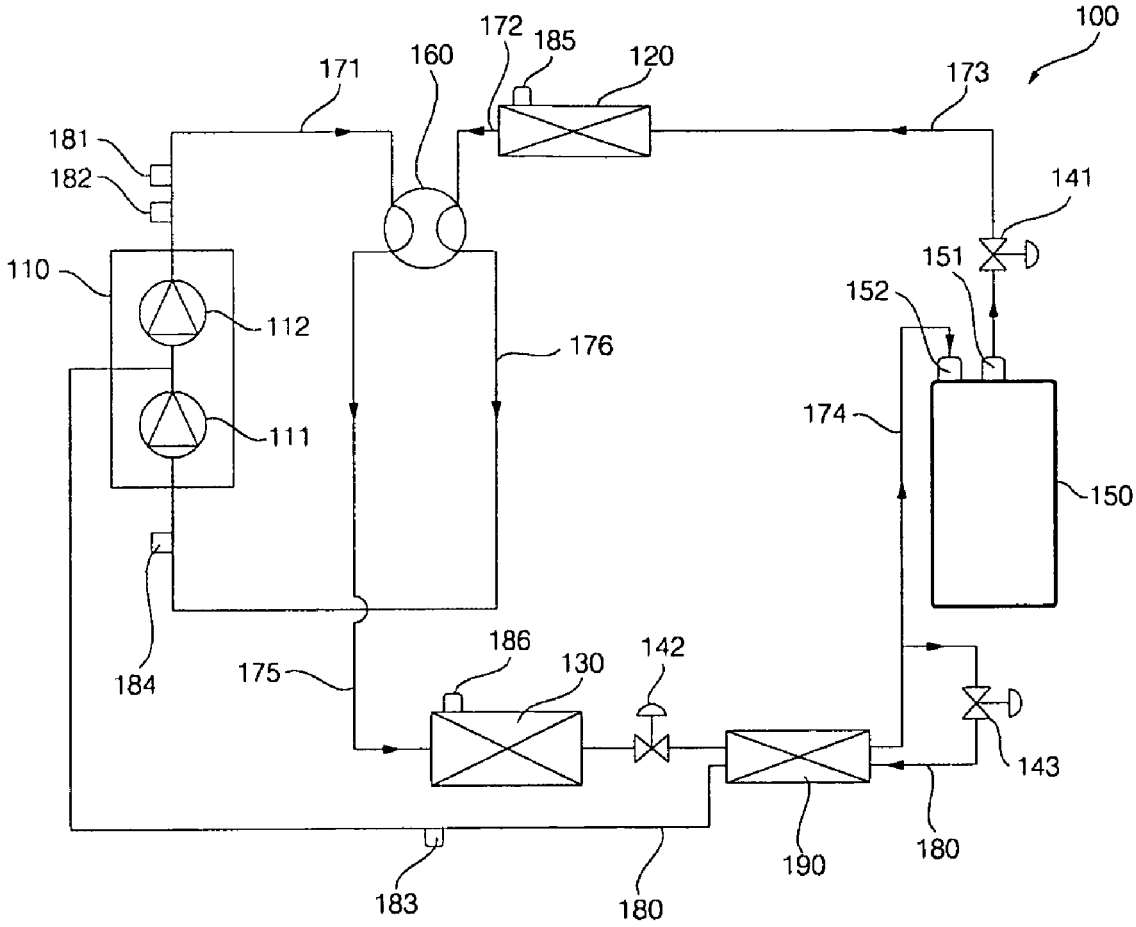
FIG. 6 illustrates the flow of refrigerant in a cooling operation of the air conditioner as shown in FIG. 1.

FIG. 6 illustrates the flow of refrigerant in a cooling operation of the air conditioner.

Referring to FIG. 6, a gaseous refrigerant of high temperature and high pressure discharged from the compressor 110 is introduced into the outdoor heat exchanger 130 via the 4-way valve 160. In the outdoor heat exchanger 130, the gaseous refrigerant is condensed by heat exchange with outside air.

The condensed refrigerant is throttled in the second expansion valve 142, and then introduced into the phase separator 150. Some of the refrigerant is bypassed to the injection valve 143 through the injection pipe 180 before introduced into to the phase separator 150. The refrigerant bypassed to the injection pipe 180 is throttled again in the injection valve 143, and is subjected to a lower temperature and pressure than the refrigerant throttled in the second expansion valve 142 is. The refrigerant throttled in the injection valve 143 is introduced into the injection heat exchanger 190.

In the injection heat exchanger 190, heat exchanger between the refrigerant passed through the injection valve 143 and the refrigerant passed through the second expansion valve 142 takes place. Because the refrigerant passed through the injection valve 143 has a lower temperature than the refrigerant passed through the second expansion valve 142 has, the refrigerant passed through the injection valve 143 absorbs heat, and the refrigerant passed through the second expansion valve 142 is deprived of heat. Accordingly, in the cooling operation, the injection heat exchanger 190 serves as a supercooler for supercooling the refrigerant condensed in the outdoor heat exchanger 130 and introduced into the phase separator 150 and the indoor heat exchanger 120.

At least some of the refrigerant having absorbed heat in the injection heat exchanger 190 is evaporated, and is subjected to a refrigerant of two phases, that is, gaseous and liquid phases in a mixed state, or a refrigerant in a superheated vapor state. Since the refrigerant of two phases or the refrigerant in a superheated vapor state is injected into the second compressing part 112 through the injection pipe 180, cooling/heating performance can be improved compared to the injection of only a gaseous refrigerant.

A method of controlling an air conditioner in accordance with the embodiment of the present invention will be described below.

When a driving command is detected, the control unit 200 initializes the first and second expansion valves 141 and 142 and the injection valve 143. The control unit 200 fully opens the first and second expansion valves 141 and 142, and closes the injection valve 143. By closing the injection valve 143, a liquid refrigerant can be prevented from being introduced into the compressor 110 at an initial stage of driving.

When the initialization of the first and second expansion valves 141 and 142 and the injection valve 143 is finished, the control unit 200 controls the opening amounts of the first expansion valve 141 and the second expansion valve 142 in different methods, respectively, among a plurality of control methods.

The plurality of control methods include a first control method in which the opening amount of the first expansion device for throttling the refrigerant coming from the condenser and introduced into the phase separator is adjusted so that the refrigerant may reach a preset intermediate pressure and a second control method in which the opening amount of the second expansion device for throttling the refrigerant coming from the condenser and introduced into the phase separator is adjusted so that the refrigerant of the air conditioner 100 may reach a preset target degree of superheat.

When the air conditioner 100 is a heating operation mode, the first expansion valve 141 serves as the first expansion device and the second expansion valve 142 serves as the second expansion device. Therefore, in the heating operation mode, the control unit 200 controls the first expansion valve 141 in the first control method, and controls the second expansion valve 142 in the second control method.

In the first control method, a value of at least one of operating parameters is detected, and a target opening degree of the first expansion valve 141 is determined based on a stored set value corresponding to the detected value of the operating parameter. The operating parameters may include the operability of gas injection in which refrigerant is injected into the second compressing part 112, the frequency of the compressor 110, the indoor temperature of the air conditioner 100, an outdoor temperature, the difference between the indoor and outdoor temperatures, the discharge pressure of the compressor 110, the discharge temperature of the compressor 110, etc. The set values for the operating parameters are preset and stored in a table format in the control unit 200. The set values for the frequency of the compressor 110 may be set differently according to the operability of gas injection. That is to say, the set values for the frequency of the compressor 110 are set differently according to the opening and closing of the injection valve 143. The target opening degree can be obtained by a combination, such as addition or multiplication, of the set values.

In the second control method, the degree of superheat of refrigerant is measured in real time, and the opening amount of the second expansion valve 142 is controlled base don the measured degree of superheat. The degree of superheat of refrigerant can be measured by an outdoor heat exchanger sensor 186 installed at the outdoor heat exchanger 130 and the compressor inlet temperature sensor 184. The control unit 200 stores a fuzzy table therein based on a difference between the measured degree of superheat and a preset target degree of superheat and a change in difference, and the opening amount of the second expansion valve 142 can be determined from the fuzzy table. In other words, the control unit 200 measures the degree of superheat of refrigerant in real time until the degree of superheat of refrigerant reaches the target degree of superheat, and continuously changes the opening amount of the second expansion valve 142 based on the measured degree of superheat. Hence, the degree of superheat of refrigerant can be adjusted more accurately.

On the other hand, when the air conditioner 100 is a cooling operation mode, the first expansion valve 141 serves as the second expansion device and the second expansion valve 142 serves as the first expansion device. Therefore, the control unit 200 controls the first expansion valve 141 in the second control method, and controls the second expansion valve 142 in the first control method.

If there is a request for performing gas injection, the control unit 200 opens the injection valve 143. At this time, upon injection of a two-phase refrigerant of liquid and gas in a mixed state, the cooling/heating in a low pressure region can be improved. However, if there is excessive liquid refrigerant, damage to the compressor 110 may occur. Therefore, the control unit 200 controls such that the refrigerant injected into the compressor 110 may be a two-phase refrigerant having a preset degree of dryness or higher or may be in a superheated vapor state. That is, the control unit 200 controls such that the ratio of a liquid refrigerant in the refrigerant injected into the compressor 110 may be less than a preset value. In order to control the ratio of a liquid refrigerant in the refrigerant injected into the compressor 110 to be less than a preset value, the injection heat exchanger 190 may be adjusted, or the opening degree of the injection valve 143 may be adjusted. This embodiment will be described with respect to the case where the opening degree of the injection valve 143 is adjusted. By adjusting the opening degree of the injection valve 143, the amount of refrigerant introduced into the injection heat exchanger is adjusted, and this enables an increase or decrease of the ratio of the liquid refrigerant in the injected refrigerant.

The opening degree of the injection valve 143 can be controlled based on a value of at least one of operating parameters. Here, the operating parameters may include the refrigerant suction temperature and refrigerant discharge temperature of the compressor 110. The opening degree of the injection valve 143 can be determined by functions of the refrigerant suction temperature and refrigerant discharge temperature of the compressor 110.

When the opening degree of the injection valve 143 is determined, the opening degree of the injection valve 143 is accordingly increased or decreased. For example, if the opening degree of the injection valve 143 is decreased, the amount of refrigerant passing through the injection pipe 180 decreases. Once the amount of refrigerant passing through the injection pipe 180 decreases, heat exchange in the injection heat exchanger 190 increases. That is to say, more heating occurs in the injection heat exchanger 190, and thus the ratio of a liquid refrigerant in the refrigerant passed through the injection heat exchanger 190 may be decreased. Hence, by adjusting the opening degree of the injection valve 143, the ratio of a liquid refrigerant in the refrigerant injected into the compressor 110 can be lowered to less than a set value. By lowering the ratio of a liquid refrigerant in the refrigerant injected into the compressor 110 to less than a set value, liquid compression in the compressor 110 is lessened, thereby improving reliability.

Figure 7:
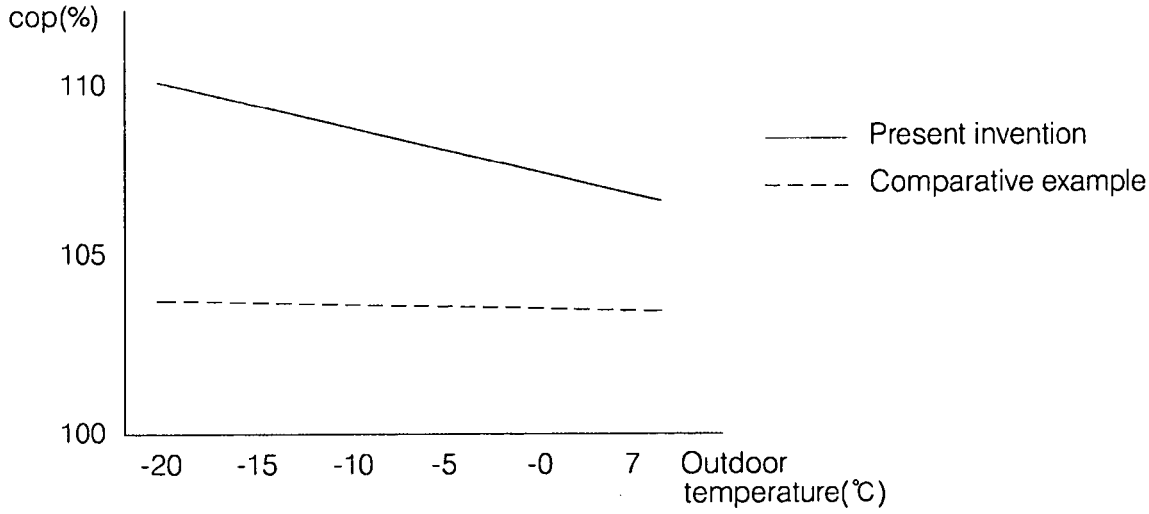
FIG. 7 is a graph illustrating the coefficient of performance of the air conditioner as shown in FIG. 1.

FIG. 7 is a graph illustrating the coefficient of performance of the air conditioner as shown in FIG. 1.

In the air conditioner according to the present invention, a liquid refrigerant is discharged from the phase separator 150, and at least some of the liquid refrigerant is evaporated as the liquid refrigerant passes through the injection valve 143 and the injection heat exchanger 190, and thus a two-phase refrigerant or a refrigerant in a superheated vapor state is injected into the compressor 110. In a comparative example as shown in FIG. 6, an air conditioner is provided in which a gaseous refrigerant is discharged from a phase separator and injected into a compressor.

Referring to FIG. 7, it can be seen that the coefficient of performance (COP) of the present invention is higher than the coefficient of performance of the comparative example. The lower the outdoor temperature, the larger the difference between the coefficient of performance of the present invention and the coefficient of performance of the comparative example. Accordingly, the air conditioner according to the present invention can have an improved performance in a low temperature region.

Although the present invention has been described with reference to the embodiment shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

The effects of the air conditioning system according to the present invention thus constructed will be described below.

The air conditioner according to the present invention can improve the cooling/heating performance of the system because the injection of refrigerant into the compressor is achieved.

Furthermore, the air conditioner according to the present invention can further improve the cooling/heating performance in a low temperature region by supplying the refrigerant injected into the compressor so as to be a two-phase refrigerant or so as to be in a superheated vapor state.

Furthermore, the air conditioner according to the present invention can prevent damage of the compressor and further improve reliability by controlling such that the ratio of a liquid refrigerant in the refrigerant injected into the compressor may be less than a set value.

What is claimed is:

1. An air conditioning system, comprising:

a compressor for compressing refrigerant;

a condenser for condensing the refrigerant discharged from the compressor;

a first expansion device for throttling the refrigerant passed through the condenser;

a second expansion device for throttling the refrigerant passed through the first expansion device;

an injection valve for throttling the refrigerant bypassed between the first expansion device and the second expansion device and injecting into the compressor;

a control unit for controlling such that the ratio of a liquid refrigerant in the refrigerant injected into the compressor is less than a predetermined value; and an injection heat exchanger for performing heat exchange between the refrigerant passed through the injection valve and the refrigerant introduced into the second expansion device when the air conditioning system is in a heating operation, wherein the injection heat exchanger is installed at a base pan of an outdoor unit included in the air conditioning system, and disposed in parallel to the base pan, wherein an outdoor heat exchanger of the outdoor unit is disposed perpendicular to the base pan and is spaced apart from the injection heat exchanger, wherein the injection heat exchanger comprises a first refrigerant pipe for passing either the refrigerant passed through the injection valve or the refrigerant introduced into the second expansion device through and a second refrigerant pipe formed so as to cover the first refrigerant pipe and for passing the other refrigerant through, wherein the injection heat exchanger is formed in a loop shape by being bent multiple times.

2. The air conditioning system of claim 1, wherein the compressor is installed at the base pan and is spaced apart from the injection heat exchanger.

3. The air conditioning system of claim 1, wherein the control unit controls the injection heat exchanger so that the ratio of a liquid refrigerant in the refrigerant injected into the compressor is less than a predetermined value.

4. The air conditioning system of claim 1, wherein the control unit controls an opening degree of the injection valve so that the ratio of a liquid refrigerant in the refrigerant injected into the compressor is less than a predetermined value.

5. The air conditioning system of claim 4, wherein the control unit detects a value of at least one of operating parameters, and adjusts the opening degree of the injection valve based on detected value of the operating parameter.

6. The air conditioning system of claim 5, wherein the operating parameters include the suction temperature of the refrigerant sucked into the compressor and the discharge temperature of the refrigerant discharged from the compressor.

7. The air conditioning system of claim 1, wherein, when the air conditioning system is in a cooling operation, the injection heat exchanger supercools the refrigerant coming from the condenser.

8. The air conditioning system of claim 1, further comprising a phase separator for storing the refrigerant passed through the first expansion device and separating the phase of the stored refrigerant.

9. The air conditioning system of claim 8, wherein only a liquid refrigerant is discharged from the phase separator.

10. The air conditioning system of claim 8, further comprising an evaporator for evaporating the refrigerant passed through the second expansion device, and the compressor comprises a first compressing part for compressing the refrigerant passed through the evaporator and a second compressing part for compressing both the refrigerant passed through the first compressing part and the refrigerant injected after bypassed between the first expansion device and the second expansion device.

11. The air conditioning system of claim 8, wherein the degree of superheat of refrigerant is measured in real time, and the opening amount of the second expansion device is changed based on the measured degree of superheat until the measured degree of superheat reaches a preset degree of superheat.

12. The air conditioning system of claim 1, wherein the control unit controls the first expansion device in a first control method, and controls the second expansion device in a second control method, different from the first control method.

13. The air conditioning system of claim 12, wherein a value of at least one of operating parameters is detected, and a target opening degree of the first expansion device is determined based on a stored set value corresponding to the detected value of the operating parameter.

14. An air conditioning system, comprising:

a compressor for compressing refrigerant;

a condenser for condensing the refrigerant discharged from the compressor;

a first expansion device for throttling the refrigerant passed through the condenser;

a second expansion device for throttling the refrigerant passed through the first expansion device;

an injection valve for throttling the refrigerant bypassed between the first expansion device and the second expansion device and injecting into the compressor;

an injection heat exchanger for performing heat exchange between the refrigerant passed through the injection valve and the refrigerant introduced into the second expansion device; and a control unit for controlling the opening degree of the injection valve so that the ratio of a liquid refrigerant in the refrigerant injected into the compressor is less than a predetermined value, wherein the injection heat exchanger is installed at a base pan of an outdoor unit included in the air conditioning system, and disposed in parallel to the base pan, wherein an outdoor heat exchanger of the outdoor unit is disposed perpendicular to the base pan and is spaced apart from the injection heat exchanger, wherein the injection heat exchanger comprises a first refrigerant pipe for passing either the refrigerant passed through the injection valve or the refrigerant introduced into the second expansion device through and a second refrigerant pipe formed so as to cover the first refrigerant pipe and for passing the other refrigerant through, wherein the injection heat exchanger is formed in a loop shape by being bent multiple times.

15. An air conditioning system, comprising:

a compressor for compressing refrigerant;

a condenser for condensing the refrigerant discharged from the compressor;

a first expansion device for throttling the refrigerant passed through the condenser;

a phase separator for storing the refrigerant coming from the first expansion device and separating the phase of the stored refrigerant;

a second expansion device for throttling the refrigerant coming from the phase separator;

an injection valve for throttling the refrigerant bypassed between the phase separator and the second expansion device and injecting into the compressor;

an injection heat exchanger for performing heat exchange between the refrigerant passed through the injection valve and the refrigerant introduced into the second expansion device; and a control unit for controlling such that the ratio of a liquid refrigerant in the refrigerant injected into the compressor is less than a predetermined value, wherein the injection heat exchanger is installed at a base pan of an outdoor unit included in the air conditioning system, and disposed in parallel to the base pan, wherein an outdoor heat exchanger of the outdoor unit is disposed perpendicular to the base pan and is spaced apart from the injection heat exchanger, wherein the injection heat exchanger comprises a first refrigerant pipe for passing either the refrigerant passed through the injection valve or the refrigerant introduced into the second expansion device through and a second refrigerant pipe formed so as to cover the first refrigerant pipe and for passing the other refrigerant through, wherein the injection heat exchanger is formed in a loop shape by being bent multiple times.

* * * * *